US008723633B2

(12) United States Patent
Moiseev et al.

(10) Patent No.: US 8,723,633 B2
(45) Date of Patent: May 13, 2014

(54) MAGNETIC CORE AND INDUCTION DEVICE

(71) Applicant: Kabushiki Kaisha Toyota Jidoshokki, Aichi-ken (JP)

(72) Inventors: Sergey Moiseev, Kariya (JP); Yasuhiro Koike, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 0 days.

(21) Appl. No.: 13/649,606

(22) Filed: Oct. 11, 2012

(65) Prior Publication Data

US 2013/0093560 A1 Apr. 18, 2013

(30) Foreign Application Priority Data

Oct. 18, 2011 (JP) ..... 2011-229131

(51) Int. Cl.
*H01F 27/24* (2006.01)
*H01F 27/08* (2006.01)

(52) U.S. Cl.
USPC ..... 336/212; 336/61; 336/216; 336/233

(58) Field of Classification Search
USPC ..... 336/61, 212, 216, 217, 233
See application file for complete search history.

(56) References Cited

U.S. PATENT DOCUMENTS 1,698,634 A * 1/1929 Johannesen ..... 336/212
2,432,948 A * 12/1947 Thompson ..... 324/726
3,793,129 A * 2/1974 Doggart et al. ..... 428/101
4,602,236 A * 7/1986 Shelby et al. ..... 336/216
6,980,077 B1 * 12/2005 Chandrasekaran et al. .. 336/212
2006/0044102 A1 * 3/2006 Tsergas et al. ..... 336/208
2006/0066433 A1 3/2006 Decristofaro et al.
2007/0261231 A1 * 11/2007 Bosley et al. ..... 29/604
2010/0254168 A1 10/2010 Chandrasekaran
2011/0121935 A1 5/2011 Chu et al.
2012/0200382 A1 8/2012 Hejny
2012/0306605 A1 12/2012 Moiseev

FOREIGN PATENT DOCUMENTS

EP 2453450 5/2012
EP 2463869 6/2012
JP 2007-95914 4/2007
WO 2010/114914 10/2010

OTHER PUBLICATIONS

Germany Office action, dated Apr. 17, 2013 along with an english translation thereof.
U.S. Appl. No. 13/649,501 to Sergey Moiseev, filed Oct. 11, 2012.

* cited by examiner

*Primary Examiner* — Alexander Talpalatski
*Assistant Examiner* — Mangtin Lian
(74) *Attorney, Agent, or Firm* — Greenblum & Bernstein, P.L.C.

(57) ABSTRACT

A magnetic core includes a first core having a recess and a second core, which has a first end portion and a second end portion both held in contact with the first core and forms a closed magnetic path with the first core. The second core is formed of material having a lower magnetic permeability and a higher saturation magnetic flux density than those of the first core. The second end portion includes a distal surface having an area larger than the cross-sectional area of the first end portion in a direction perpendicular to the direction in which a magnetic flux flows in the closed magnetic path. The distal surface of the second end portion is held in contact with the first core and the first end portion is engaged with the recess in the first core.

12 Claims, 1 Drawing Sheet

MAGNETIC CORE AND INDUCTION DEVICE

BACKGROUND OF THE INVENTION

The present invention relates to a magnetic core and an induction device having the magnetic core.

Induction devices such as reactors or transformers, which are configured by winding a coil around a magnetic core, are conventional. Some of such induction devices have a magnetic core employing a ferrite core and a dust core in combination. See, for example, Japanese Laid-Open Patent Publication No. 2007-95914.

A core described in the aforementioned document includes an E-shaped core having three magnetic legs and a flat plate-like I-shaped core having a pair of cutout portions. Two of the magnetic legs arranged at opposite ends of the E-shaped core are joined to the cutout portions of the I-shaped core. This configuration facilitates positioning the E-shaped core with respect to the I-shaped core when the E-shaped core is attached to the I-shaped core.

In the above-described core, if the I-shaped core is formed using a ferrite core and the E-shaped core, around which a coil is wound, is formed by a dust core, the cross-sectional area of a portion where the coil is wound and the winding length of the coil are expected to be reduced. However, if each of the magnetic legs of the dust core contacts the ferrite core by a small contact area, magnetic flux saturation may occur in a portion of the ferrite core that contacts the dust core. This may make it impossible to obtain desirable direct current superimposing characteristics.

To solve this problem, in the core described in the aforementioned document, the distal surface and the corresponding side surface of each of the magnetic legs of the dust core may be held in contact with the corresponding one of the cutout portions to increase the contact area between the magnetic leg and the cutout portion. However, when the two magnetic legs are joined to the cutout portions as in the case of the aforementioned document, the interval between the magnetic legs must be greater than the interval between the cutout portions to facilitate mounting the dust core. This makes it difficult to hold the distal surfaces and the side surfaces of all the magnetic legs in contact with the ferrite core in the above-described document. As a result, it is impossible to ensure a sufficiently large contact area between the cores.

SUMMARY OF THE INVENTION

Accordingly, it is an objective of the present invention to provide a magnetic core that ensures a sufficiently large contact area between opposing cores and is easy to manufacture, and to provide an induction device including the magnetic core.

To achieve the foregoing objective and in accordance with a first aspect of the present invention, a magnetic core is provided that includes a first core having a recess and a second core having a first end portion and a second end portion both held in contact with the first core. The second core forms a closed magnetic path with the first core. The second core is formed of a material having a lower magnetic permeability and a higher saturation magnetic flux density than those of the first core. The second end portion includes a distal surface having an area larger than the cross-sectional area of the first end portion in a direction perpendicular to a direction in which a magnetic flux flows in the closed magnetic path. The distal surface of the second end portion is held in contact with the first core, and the first end portion is engaged with the recess in the first core.

In accordance with another aspect of the present invention, an induction device is provided that includes the magnetic core of the first aspect and a core wound about the second core member.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1A:
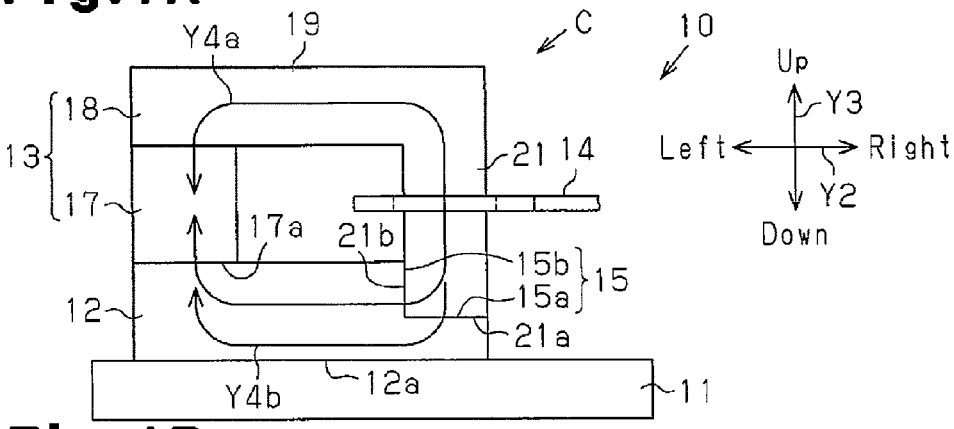
FIG. 1A is a front view schematically showing a magnetic core and a reactor according to one embodiment of the present invention.
Figure 1B:
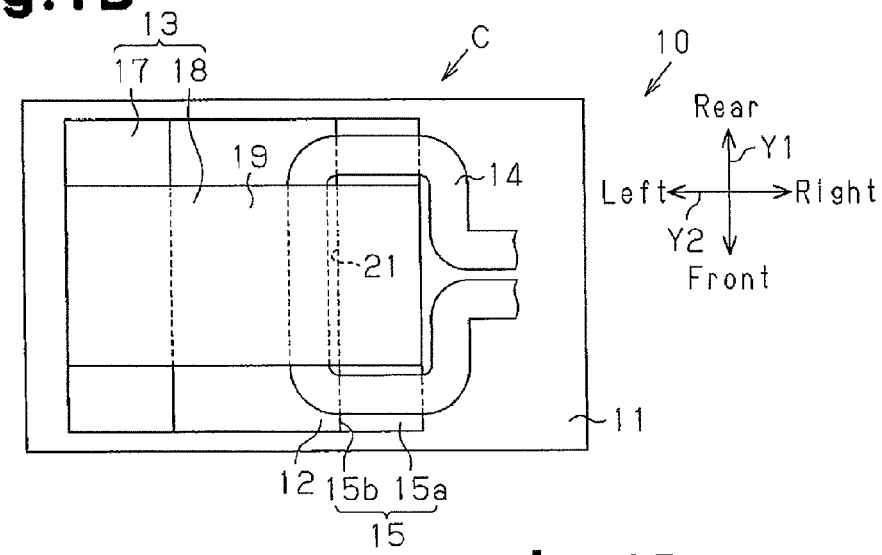
FIG. 1B is a plan view schematically showing the magnetic core and the reactor illustrated in FIG. 1A.
Figure 1C:
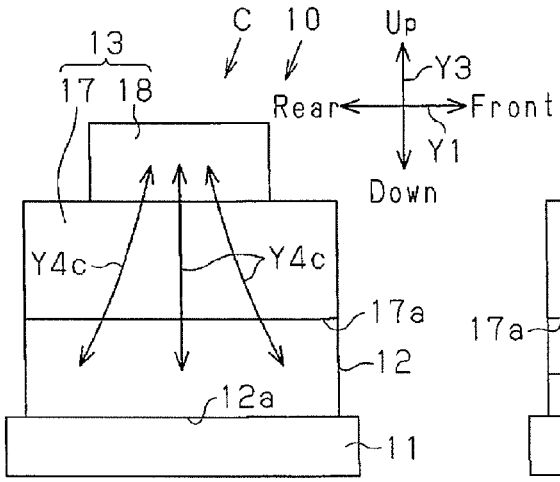
FIG. 1C is a left side view schematically showing the magnetic core and the reactor illustrated in FIG. 1A.
Figure 1D:
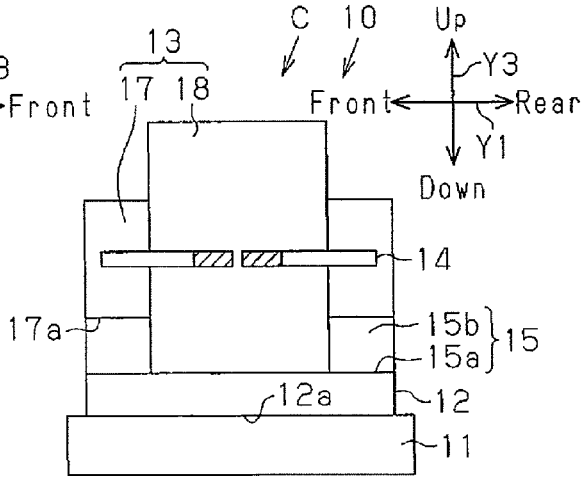
FIG. 1D is a right side view schematically showing the magnetic core and the reactor illustrated in FIG. 1A.

A magnetic core and an induction device according to one embodiment of the present invention will now be described with reference to FIGS. 1A to 1D.

As shown in FIGS. 1A to 1D, a reactor 10, which serves as an induction device, is fixed to a heat dissipating plate 11, which is formed of, for example, aluminum, in the illustrated embodiment. For illustrative purposes in the description below, the direction represented by arrow Y1, which is parallel to the heat dissipating plate 11, is defined as the front-rear direction. The direction represented by arrow Y2, which is parallel to the heat dissipating plate 11 and perpendicular to the direction of arrow Y1, is defined as the left-right direction or the lateral direction. The direction represented by arrow Y3, which is perpendicular to the heat dissipating plate 11, is defined as the up-down direction or the vertical direction.

The reactor 10 includes an I-shaped core 12 and a U-shaped core 13, which serve as a first core and a second core, respectively, and a coil 14 wound around the U-shaped core 13. The I-shaped core 12 is fixed to the upper surface of the heat dissipating plate 11 using, for example, adhesive. The U-shaped core 13 is mounted on the I-shaped core 12 from above. The I-shaped core 12 and the U-shaped core 13 form a magnetic core C.

The I-shaped core 12 is a ferrite core formed of ferrite such as MnZn based material or NiMn based material. The I-shaped core 12 as a whole is shaped like a flat rectangular plate extending in the left-right (lateral) direction as viewed from above. The I-shaped core 12 has a cutout portion 15 serving as a recess, which is formed in a right peripheral end portion (a right end portion) of the I-shaped core 12. The cutout portion 15 is formed by cutting the corresponding portion of the I-shaped core 12 downward from the position corresponding to the upper surface of the I-shaped core 12 across the full width in the front-rear direction. In other words, the cutout portion 15 is formed such that a bottom surface 15*a* and a side surface 15*b* cross each other at a right angle as viewed from the front. The right end portion of the I-shaped core 12 substantially has a stepped-like shape (is shaped like a step), as viewed from the front. The lower surface of the I-shaped core 12 is a contact surface 12*a*, which is held in contact with the heat dissipating plate 11.

The U-shaped core 13 is a dust core (a powder core) formed through pressure molding using powder (dust material) of, for example, Fe—Al—Si based material, which has surfaces coated with insulating plastic material. The dust material forming the U-shaped core 13 has lower magnetic permeability and higher saturation magnetic flux density than those of ferrite.

The U-shaped core 13 has a first core member 17 shaped like a flat plate, which extends in the front-rear direction as viewed from above. The first core member 17 is fixed to the upper surface of a left peripheral end portion (a left end portion) of the I-shaped core 12 using adhesive, for example. The length in the front-rear direction of the first core member 17 is equal to the length in the front-rear direction of the I-shaped core 12 across the full width of the first core member 17. In the illustrated embodiment, the first core member 17 corresponds to a second end portion, and a lower surface 17*a* of the first core member 17 corresponds to a distal surface.

The U-shaped core 13 has a second core member 18 that includes a flat portion 19 and a leg portion 21. The flat portion 19 has a flat rectangular plate-like shape extending in the lateral direction as viewed from above and extends parallel to the I-shaped core 12. The leg portion 21 is shaped like a rectangular pillar and extends downward from a right peripheral end portion (a right end portion) of the flat portion 19. In other words, in the second core member 18, the leg portion 21 is perpendicular to the contact surface 12*a* (the heat dissipating plate 11) and extends toward (downward to) the I-shaped core 12 (the contact surface 12*a*). In the illustrated embodiment, the second core member 18 and the first core member 17 are separate components. In the second core member 18 of the embodiment, the leg portion 21 corresponds to a first end portion.

A distal portion of the leg portion 21 is fitted in, or, in other words, engaged with, the cutout portion 15, which is formed in the I-shaped core 12. A distal surface 21*a* of the leg portion 21 contacts the bottom surface 15*a* of the cutout portion 15. A side surface 21*b* of the leg portion 21, which is arranged at the left side of the distal surface 21*a*, contacts the side surface 15*b* of the cutout portion 15.

The lower surface of a left peripheral end portion (a left end portion) of the flat portion 19 is held in contact with the upper surface of the first core member 17. The distance from the upper surface of the heat dissipating plate 11 (the contact surface 12*a*) to the upper surface of the first core member 17 is equal to the distance from the upper surface of the heat dissipating plate 11 to the lower surface of the flat portion 19 of the second core member 18.

As has been described, the U-shaped core 13 is formed by the first core member 17 and the second core member 18 and has a U shape as a whole as viewed from the front. The leg portion 21 of the second core member 18 is held in contact with the cutout portion 15 of the I-shaped core 12 at the distal surface 21*a* and the side surface 21*b*. The contact area between the leg portion 21 and the I-shaped core 12 is larger than the area of the distal surface 21*a* of the leg portion 21.

Also, the contact area between the first core member 17 and the I-shaped core 12 (which is the area of the lower surface 17*a*) is larger than the contact area between the first core member 17 and the second core member 18 and the cross-sectional area of the leg portion 21 in the direction perpendicular to the up-down direction (the vertical direction) (which is the area of the distal surface 21*a*).

The cross-sectional area of the flat portion 19 of the second core member 18 at the longitudinal (lateral) middle of the flat portion 19 is smaller than the cross-sectional area of the I-shaped core 12 at the longitudinal (lateral) middle, except for the portion corresponding to the cutout portion 15. The cross-sectional area of the leg portion 21 of the second core member 18 in the direction perpendicular to the vertical direction is smaller than the cross-sectional area of the first core member 17 in the direction perpendicular to the vertical direction.

The second core member 18 of the U-shaped core 13 extends in the lateral direction at the middle of the I-shaped core 12 and the first core member 17 in the front-rear direction. As a result, by combining the I-shaped core 12 with the U-shaped core 13 (the first core member 17 and the second core member 18), the magnetic core C is shaped as a rectangular frame (a rectangular ring) as viewed from the front.

A coil 14 is wound around the leg portion 21 of the second core member 18. In other words, the second core member 18 is joined to the I-shaped core 12 and the first core member 17 with the leg portion 21 passed through the coil 14. In the illustrated embodiment, the coil 14 is wound (turned) one time. The leg portion 21 of the second core member 18 corresponds to a winding portion for the coil 14.

A method for forming, or manufacturing, the reactor 10 will hereafter be described.

First, the first core member 17 is fixed to the upper surface of the left peripheral end portion (the left end portion) of the I-shaped core 12 using fixing means such as adhesive. The I-shaped core 12, which now has the first core member 17 fixed to the I-shaped core 12, is then fixed to the upper surface of the heat dissipating plate 11 using fixing means such as adhesive. Subsequently, the coil 14 is mounted at the position corresponding to the cutout portion 15, in which the leg portion 21 of the second core member 18 is arranged, from above the I-shaped core 12 (the heat dissipating plate 11).

Next, the leg portion 21 is passed through the coil 14 and, meanwhile, the second core member 18 is joined to the I-shaped core 12 from above the I-shaped core 12 (the heat dissipating plate 11). This causes contact between the upper surface of the first core member 17 and the lower surface of the flat portion 19 of the second core member 18 and contact between the distal surface 21*a* of the leg portion 21 and the bottom surface 15*a* of the cutout portion 15 in the I-shaped core 12. In this state, the second core member 18 is moved leftward (toward the first core member 17) to cause the side surface 21*b* of the leg portion 21 of the second core member 18 to contact the side surface 15*b* of the cutout portion 15 of the I-shaped core 12. As a result, the magnetic core C and the reactor 10 are completed.

Accordingly, even if a manufacturing error causes the length in the lateral direction of the cutout portion 15 in the I-shaped core 12 to be small or great, for example, close contact (contact) is brought about between the distal surface 21*a* and the side surface 21*b* of the leg portion 21 of the second core member 18 and the I-shaped core 12 (the cutout portion 15).

Operation of the reactor 10 will now be described.

As indicated by arrows Y4*a* and Y4*b* in FIG. 1A, the reactor 10 forms a closed magnetic path for magnetic flux to flow through the leg portion 21, the flat portion 19, the first core member 17, the I-shaped core 12, and the leg portion 21 in this or reverse order at the time when the coil 14 receives electric power. In other words, the U-shaped core 13 forms the closed magnetic path together with the I-shaped core 12 and the first core member 17 and the leg portion 21 of the U-shaped core 13 each serve as a magnetic leg for forming a magnetic path with respect to the I-shaped core 12. The cross-sectional areas of the flat portion 19 and the leg portion 21 of the second core member 18 in the direction perpendicular to the flow direction of the magnetic flux in the closed magnetic path are smaller than the cross-sectional areas of the I-shaped core 12 and the first core member 17 in the direction perpendicular to the flow direction of the magnetic flux in the closed magnetic path. The area of the lower surface 17*a* of the first core member 17 is larger than the cross-sectional area of the leg portion 21 in the direction perpendicular to the flow direction of the magnetic flux in the closed magnetic path.

The leg portion 21 of the second core member 18 is held in contact with the I-shaped core 12 through the distal surface 21*a* and the side surface 21*b*. This allows the magnetic flux to flow through not only the contact portion (the contact surface) between the side surface 21*b* of the leg portion 21 and the I-shaped core 12, as indicated by arrow Y4*a*, but also the contact portion (the contact surface) between the distal surface 21*a* of the leg portion 21 and the I-shaped core 12, as indicated by arrow Y4*b*. As a result, the I-shaped core 12, which is formed of ferrite, is prevented from causing magnetic flux saturation in the contact portions between the leg portion 21 of the second core member 18 and the I-shaped core 12.

The U-shaped core 13 contacts the upper surface of the I-shaped core 12 at the entire lower surface 17*a* of the first core member 17. This allows the magnetic flux to pass through the entire lower surface 17*a* of the first core member 17, as indicated by arrow Y4*c* in FIG. 1C. As a result, the I-shaped core 12 is prevented from causing magnetic flux saturation in the contact portion between the first core member 17 and the I-shaped core 12.

As a result, the first core member 17 serves as an enlargement portion for enlarging the contact area between the first core member 17 and the I-shaped core 12 compared to the cross-sectional area of the leg portion 21 in the direction perpendicular to the vertical direction. Specifically, the contact area between the first core member 17 and the second core member 18 is small compared to the area of the lower surface 17*a* of the first core member 17. However, since the dust material has a high saturation magnetic flux density, magnetic flux saturation is prevented from occurring in the contact portion between the first core member 17 and the second core member 18.

The illustrated embodiment has the advantages described below.

(1) The first core member 17 of the U-shaped core 13 has the lower surface 17*a*, which has an area larger than the cross-sectional area of the leg portion 21 of the second core member 18 in the direction perpendicular to the flow direction of the magnetic flux in the closed magnetic path. The first core member 17 contacts the I-shaped core 12 at the lower surface 17*a*. The distal portion of the leg portion 21 of the second core member 18 is fitted in, or, in other words, engaged with, the cutout portion 15 formed in the I-shaped core 12. As a result, compared to a leg portion 21 held in contact with the I-shaped core 12 simply through the distal surface 21*a*, the leg portion 21 of the embodiment contacts the I-shaped core 12 by a large contact area. Specifically, the distal portion of the leg portion 21 is fitted in, or engaged with, the cutout portion 15 in the I-shaped core 12. In this state, the lower surface 17*a* of the first core member 17 contacts the I-shaped core 12. This ensures a sufficiently large contact area between the cores and facilitates manufacture of the magnetic core, unlike the conventional configuration in which the opposite ends of the U-shaped core are fitted in the corresponding recesses (cutout portions), which are formed in the I-shaped core.

(2) The second core member 18 has the leg portion 21, which corresponds to an end of the U-shaped core 13, and is independent from the first core member 17, which corresponds to the other end of the U-shaped core 13. In this configuration, after the first core member 17 is fitted in, or, in other words, adhered to, the I-shaped core 12, the distal portion of the leg portion 21 is mounted in, or engaged with, the cutout portion 15 in the I-shaped core 12. In this state, the second core member 18 is mounted such that the left end portion of the flat portion 19 contacts the first core member 17. In other words, the magnetic core is manufactured with increased simplicity.

(3) The cutout portion 15, which receives the distal portion (the lower end portion) of the leg portion 21 of the second core member 18, is formed in the I-shaped core 12 by cutting out a portion of the I-shaped core 12. This allows the second core member 18 to be moved laterally when the second core member 18 is joined to the I-shaped core 12. As a result, the side surface 21*b* of the leg portion 21 is brought into close contact with the side surface 15*b* of the cutout portion 15 with improved reliability.

(4) The I-shaped core 12 has the cutout portion 15, which extends along the full width of the I-shaped core 12 in the front-rear direction. This allows adjustment of the location of the second core member 18 in correspondence with the mounting position of the coil 14 in the front-rear direction.

The present invention is not restricted to the illustrated embodiment but may be embodied in the forms described below.

The cutout portion 15 may be formed such that an acute or obtuse angle is formed between the bottom surface 15*a* and the side surface 15*b*. In this case, the leg portion 21 of the second core member 18 does not necessarily have to extend perpendicular to the contact surface 12*a* (the heat dissipating plate 11), as long as the leg portion 21 is formed at the angle corresponding to the angle of the cutout portion 15.

The length of the first core member 17 in the front-rear direction may be smaller than the length of the I-shaped core 12 in the front-rear direction.

The shape of the first core member 17 and the shape of the leg portion 21 may be changed as needed. For example, the leg portion 21 may have a circular or oval shape as viewed from above. In this case, the cutout portion 15 of the I-shaped core 12 has to be formed as a recess shaped in correspondence with the shape of the leg portion 21.

The I-shaped core 12 may include a recess of a different shape. For example, the cutout portion 15 may be formed in a portion of the right peripheral portion (the right portion) of the I-shaped core 12 such that the width in the front-rear direction of the cutout portion 15 is equal to the width in the front-rear direction of the leg portion 21 of the second core member 18. Alternatively, a rectangular recess shaped identically with the outline of the leg portion 21, as viewed from above, may be formed. Also, the leg portion 21 may have, for example, a semispherical distal portion. In this case, the I-shaped core 12 must have a concave surface having a shape corresponding to the semispherical shape of the distal portion of the leg portion 21.

The I-shaped core 12 and the U-shaped core 13 (the first core member 17 and the second core member 18) may each have a corner portion including an inclined surface (a chamfered surface) or an arcuate surface (a rounded surface), which extends along the full width of the cores 12, 13 in the front-rear direction.

The first core member 17 and the second core member 18 may be formed integrally with each other. The first core member 17 may be fixed to the lower surface of the left end portion of the flat portion 19 of the second core member 18 using, for example, adhesive. This configuration also ensures close contact between the side surface 21*b* of the leg portion 21 of the second core member 18 and the side surface 15*b* of the cutout portion 15.

The second core member 18 may be fixed using a holder that urges the second core member 18 toward the I-shaped core 12 and the first core member 17.

The coil 14 may be wound two or more turns. The coil 14 may be formed by winding a copper line coated with coating material such as insulating plastic.

The first core member 17 and the leg portion 21 of the second core member 18 may be inclined with respect to the contact surface 12*a* (the heat dissipating plate 11). In other words, the first core member 17 and the leg portion 21 may extend each in a direction crossing the I-shaped core 12 or the contact surface 12*a* (the heat dissipating plate 11).

The flat portion 19 of the second core member 18 does not necessarily have to be formed parallel to the I-shaped core 12.

The present invention may be embodied as an induction device (an electronic device) having a plurality of reactors 10 mounted on the heat dissipating plate 11. For example, to form a specific number (a specific multiple number) of reactors 10 on the heat dissipating plate 11, the specific number of I-shaped cores 12 each having a first core member 17 fixed to the I-shaped core 12 are adhered to the heat dissipating plate 11. Then, a single circuit substrate having at least a specific number of coils 14 is mounted such that the respective coils 14 are arranged in correspondence with the cutout portions 15 of the corresponding I-shaped cores 12. Afterwards, the respective leg portions 21 are passed through the corresponding coils 14 and the second core members 18 are consecutively mounted. The reactors 10 are thus completed. This configuration facilitates mounting of the coils 14, which are arranged on the single circuit substrate, and ensures efficient assembly of the multiple reactors 10, compared to a configuration in which an E-shaped core, instead of an I-shaped core 12, is fixed to the heat dissipating plate 11. Alternatively, some or all of the multiple reactors 10 may be formed each as a transformer including a plurality of coils 14.

The I-shaped core 12 may be fixed to a case accommodating the reactor 10 using, for example, adhesive.

The U-shaped core 13 may be formed through pressure molding using metal glass powder having surfaces coated with insulating plastic.

Magnetic paste or a magnetic sheet, for example, may be arranged between the I-shaped core 12 and the first core member 17 and the leg portion 21 of the second core member 18 and the I-shaped core 12. In other words, the I-shaped core 12 and the first core member 17 or the leg portion 21 and the I-shaped core 12 may contact each other either directly or indirectly through another component.

The present invention may be used in a transformer as an induction device including a plurality of coils 14.

Therefore, the present examples and embodiments are to be considered as illustrative and not restrictive and the invention is not to be limited to the details given herein, but may be modified within the scope and equivalence of the appended claims.

The invention claimed is:

1. A magnetic core comprising:

a first core having a recess; and a second core having a first end portion and a second end portion both held in contact with the first core, the second core forming a closed magnetic path with the first core, wherein the second core comprises a material having a lower magnetic permeability and a higher saturation magnetic flux density than a magnetic permeability and a saturation magnetic flux density of the first core, the second end portion includes a distal end surface having a cross-sectional area larger than a cross-sectional area of the first end portion in a direction perpendicular to a direction in which a magnetic flux flows in the closed magnetic path, the distal end surface of the second end portion is held in contact with the first core, and the first end portion is engaged with the recess in the first core, the first end portion has a distal end surface and a side surface, which is perpendicular to the distal end surface of the first end portion, and the first end portion is held in contact with the first core at the distal end surface and the side surface of the first end portion, and a cross-sectional area of the first core is greater than a cross-sectional area of the second core at a longitudinal middle.

2. The magnetic core according to claim 1, wherein the second core includes:

a first core member and a second core member;

wherein the second core member has the first end portion and a third end portion located opposite to the first end portion, and the first core member comprises a component independent from the second core member, has the second end portion, and is held in contact with the third end portion of the second core member.

3. The magnetic core according to claim 2, wherein the contact area between the distal end surface and the first core is larger than the contact area between the third end portion of the second core member and the first core member.

4. The magnetic core according to claim 1, wherein the recess is provided by cutout in an end portion of the first core.

5. The magnetic core according to claim 1, wherein the first core comprises an I-shaped core and the second core comprises a U-shaped core.

6. The magnetic core according to claim 1, wherein the recess is positioned at a first end portion of the first core, a second and opposite end portion of the first core being free of a corresponding recess.

7. An induction device comprising:

a magnetic core and;

a coil, wherein the magnetic core includes:

a first core having a recess; and a second core including a first end portion and a second end portion both held in contact with the first core, the second core forming a closed magnetic path with the first core, the second core comprises a material having a lower magnetic permeability and a higher saturation magnetic flux density than a magnetic permeability and a saturation magnetic flux density of the first core, the second end portion includes a distal end surface having a cross-sectional area larger than a cross-sectional area of the first end portion in a direction perpendicular to a direction in which a magnetic flux flows in the closed magnetic path, the distal end surface of the second end portion is held in contact with the first core, and the first end portion is engaged with the recess in the first core, and the coil is wound around the second core, the first end portion has a distal end surface and a side surface, which is perpendicular to the distal end surface of the first end portion, and the first end portion is held in contact with the first core at the distal end surface and the side surface of the first end portion, and a cross-sectional area of the first core is greater than a cross-sectional area of the second core at a longitudinal middle.

8. The induction device according to claim 7, wherein the second core includes a first core member and a second core member, the second core member includes the first end portion and a third end portion located opposite to the first end portion, and the first core member comprises a component independent from the second core member, includes the second end portion, and is held in contact with the third end portion of the second core member.

9. The induction device according to claim 8, wherein a contact area between the distal end surface and the first core is larger than a contact area between the third end portion of the second core member and the first core member.

10. The induction device according to claim 7, wherein the recess comprises a cutout in an end portion of the first core.

11. The induction device according to claim 7, wherein the first core comprises an I-shaped core and the second core comprises a U-shaped core.

12. The induction device according to claim 7, wherein the recess is positioned at a first end portion of the first core, a second and opposite end portion of the first core being free of a corresponding recess.

* * * * *